US009949573B1

(12) United States Patent
Huang

(10) Patent No.: US 9,949,573 B1
(45) Date of Patent: Apr. 24, 2018

(54) THREE-LAYER THREE-ZONE MEMORY FOAM MATTRESS

(71) Applicant: Shuimu Huang, Foshan (CN)

(72) Inventor: Shuimu Huang, Foshan (CN)

( * ) Notice: Subject to any disclaimer, the term of this patent is extended or adjusted under 35 U.S.C. 154(b) by 0 days.

(21) Appl. No.: 15/798,477

(22) Filed: Oct. 31, 2017

(51) Int. Cl.
*A47C 27/14* (2006.01)
*A47C 27/15* (2006.01)

(52) U.S. Cl.
CPC ..... *A47C 27/148* (2013.01); *A47C 27/15* (2013.01)

(58) Field of Classification Search
CPC ..... A47C 27/148; A47C 27/144; A47C 27/15
See application file for complete search history.

(56) References Cited

U.S. PATENT DOCUMENTS 112,175 A * 2/1871 Pack ..... A47C 27/148 5/722
3,521,311 A * 7/1970 Cohen ..... A47C 27/144 5/727
4,706,313 A * 11/1987 Murphy ..... A47C 27/148 5/722
5,960,496 A * 10/1999 Boyd ..... A47C 27/144 5/722
7,191,483 B2 * 3/2007 Hochschild ..... A47C 27/001 5/691
7,386,903 B2 * 6/2008 Hochschild ..... A47C 27/001 5/691
7,469,437 B2 * 12/2008 Mikkelsen ..... A47C 7/022 5/655.9
7,757,322 B2 * 7/2010 An ..... A47C 27/001 5/722
8,245,341 B2 * 8/2012 Oh ..... A47C 27/144 5/722
9,775,444 B2 * 10/2017 Oh ..... A47C 31/005

* cited by examiner

*Primary Examiner* — Eric J Kurilla
(74) *Attorney, Agent, or Firm* — Law Offices of Steven W. Weinrieb

(57) ABSTRACT

The present invention discloses a three-layer three-zone memory foam mattress, comprising a mattress main body, wherein the mattress main body is composed of a top layer mattress body, a middle layer mattress body and a base layer mattress body, which are sequentially arranged from top to bottom, and a mattress cover is arranged on the surface of the mattress main body; and the middle layer mattress body is composed of a head mattress body, a waist and hip mattress body and a foot mattress body. The mattress is divided into three layers, the first layer is made of the colored gel memory foam, the second layer divides the high-density foam into three zones, the first and third zone adopt the retarding foam, while the second zone adopts the reinforced resilient foam, and the third layer is made of the physical solid-state reinforced foam. The colored gel memory foam can keep the consistency of body contact temperature to create a comfortable sleep environment, the surface and the bottom are made of foam with different hardness to create a sleep effect with one soft surface and one hard surface so as to satisfy the requirements of people at different ages for the hardness of the mattress, and the mattress ensures better fitting of the body and the mattress by means of the special hardness plasticity of the foam products.

7 Claims, 1 Drawing Sheet

THREE-LAYER THREE-ZONE MEMORY FOAM MATTRESS

FIELD OF THE INVENTION

The present invention relates to a foam mattress, and in particular to a three-layer three-zone memory foam mattress, and belongs to the technical field of mattresses.

BACKGROUND OF THE INVENTION

One third of our life is spent in sleep. Four signs to measure whether people have a "healthy sleep" include full sleep, enough time, good quality and high efficiency; it is easy to sleep; the sleep is continuous and is not interrupted; the sleep is deep and suitable, and the fatigue is completely eliminated after wakeup and the like. The sleep quality is closely related to the mattresses, consumers can purchase mattresses with proper types and high quality based on the permeability, decompression, supporting degrees, obedience, bed tension, sleep temperature and sleep humidity and other aspects of the mattresses. The most basic requirement is to keep the lumbar physiological lordosis and a normal body curve during supination; and lumbar bending and lateral bending are not caused during side lying. The existing market products are targeted at horizontal profile stratification and cannot well target at the stress distribution data of all the body parts of people with all weights, resulting in that the products are too monotonous and lack sustainable improvement.

SUMMARY OF THE INVENTION

The technical problem to be solved by the present invention is to overcome the defect that the existing mattress only targets at horizontal profile stratification and cannot well target at the stress distribution data of all the body parts of people with all weights, resulting in that the products are too monotonous and lack sustainable improvement, and to provide a three-layer three-zone memory foam mattress. In order to solve the above technical problem, the present invention provides the following technical solution:

The present invention provides a three-layer three-zone memory foam mattress, including a mattress main body, wherein the mattress main body is composed of a top layer mattress body, a middle layer mattress body and a base layer mattress body, which are sequentially arranged from top to bottom, and a mattress cover is arranged on the surface of the mattress main body; and the middle layer mattress body is composed of a head mattress body, a waist and hip mattress body and a foot mattress body.

As a preferred technical solution of the present invention, the top layer mattress body is made of colored gel memory foam As a preferred technical solution of the present invention, the head mattress body and the foot mattress body are made of retarding foam, and the waist and hip mattress body is made of reinforced resilient foam.

As a preferred technical solution of the present invention, the base layer mattress body is made of physical solid-state reinforced foam.

As a preferred technical solution of the present invention, the hardness proportion of the top layer mattress body, the middle layer mattress body and the base layer mattress body is 2:5:3.

As a preferred technical solution of the present invention, the length proportion of the head mattress body, the waist and hip mattress body and the foot mattress body is 1:1:1.

The present invention has the following beneficial effects: the mattress is divided into three layers, the first layer is made of the colored gel memory foam, the second layer divides the high-density foam into three zones, the first and third zone adopt the retarding foam, and the second zone adopts the reinforced resilient foam, and the third layer is made of the physical solid-state reinforced foam; the colored gel memory foam can keep the consistency of body contact temperature to create a comfortable sleep environment, the surface and the bottom are made of foam with different hardness to create a sleep effect with one soft surface and one hard surface so as to satisfy the requirements of people at different ages for the hardness of the mattress; the reinforced resilient foam is used on the waist and hip positions, and the retarding foam is used on the positions of the head and the feet to keep the lumbar physiological lordosis and a normal body curve during supination, and lumbar bending and lateral bending are not caused during side lying; and the mattress realizes different supporting forces through technical means by means of the special hardness plasticity of the foam products, so that the body and the mattress are better fitted, the stress distribution data of all the body parts of people with all the weights can be well targeted, and the skin affinity is higher.

BRIEF DESCRIPTION OF THE DRAWINGS

The drawings are used for providing further understanding of the present invention, constitute a part of the description and are used for explaining the present invention together with the embodiment of the present invention, but do not constitute a limitation to the present invention. In the drawings.

REFERENCE SIGNS

1: mattress main body; 2: top layer mattress body; 3: middle layer mattress body; 4: base layer mattress body; 5: mattress cover; 6: head mattress body; 7: waist and hip mattress body; and 8: foot mattress body.

DETAILED DESCRIPTION OF THE EMBODIMENTS

The preferred embodiment of the present invention will be illustrated below in combination with the drawings, it should be understood that the preferred embodiment described herein is merely used for illustrating and explaining the present invention, rather than limiting the present invention.

Embodiment 1

Figure 1:
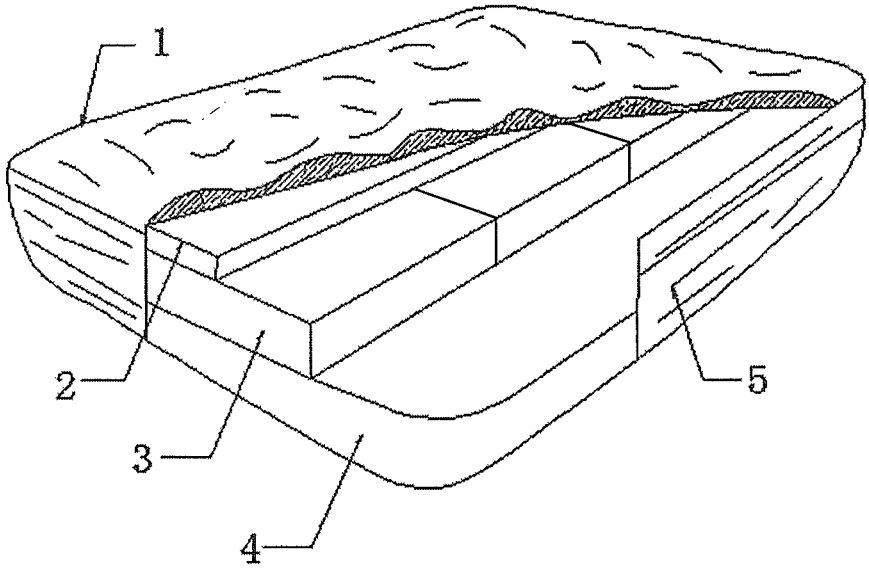
FIG. 1 is a structural schematic diagram of the present invention.
Figure 2:
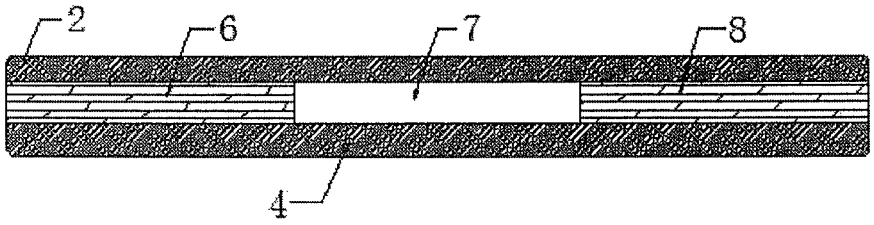
FIG. 2 is a sectional view of the present invention.

As shown in FIG. 1 to FIG. 2, the present invention provides a three-layer three-zone memory foam mattress, including a mattress main body 1, wherein the mattress main body 1 is composed of a top layer mattress body 2, a middle layer mattress body 3 and a base layer mattress body 4, which are sequentially arranged from top to bottom, and a mattress cover 5 is arranged on the surface of the mattress main body 1; and the middle layer mattress body 3 is composed of a head mattress body 6, a waist and hip mattress body 7 and a foot mattress body 8. The top layer mattress body 2 is made of colored gel memory foam. The head mattress body 6 and the foot mattress body 8 are made of retarding foam, and the waist and hip mattress body 7 is made of reinforced resilient foam. The base layer mattress body 4 is made of physical solid-state reinforced foam. The hardness proportion of the top layer mattress body 2, the middle layer mattress body 3 and the base layer mattress body 4 is 2:5:3. The length proportion of the head mattress body 6, the waist and hip mattress body 7 and the foot mattress body 8 is 1:1:1. In the present invention, the mattress is divided into three layers, the first layer is made of the colored gel memory foam, the second layer divides the high-density foam into three zones, the first and third zone adopt the retarding foam, while the second zone adopts the reinforced resilient foam, and the third layer is made of the physical solid-state reinforced foam; the colored gel memory foam can keep the consistency of body contact temperature to create a comfortable sleep environment, the surface and the bottom are made of foam with different hardness to create a sleep effect with one soft surface and one hard surface so as to satisfy the requirements of people at different ages for the hardness of the mattress; the reinforced resilient foam is used on the waist and hip positions, and the retarding foam is used on the positions of the head and the feet to keep the lumbar physiological lordosis and a normal body curve during supination, and lumbar bending and lateral bending are not caused during side lying; and the mattress realizes different supporting forces through technical means by means of the special hardness plasticity of the foam products, so that the body and the mattress are better fitted, the stress distribution data of all the body parts of people with all weights can be well targeted, and the skin affinity is higher.

Finally, it should be noted that the foregoing description is merely a preferred embodiment of the present invention, rather than limiting the present invention. Although the present invention has been described in detail with reference to the foregoing embodiment, those of ordinary skill in the art can still make modifications to the technical solutions recorded in the foregoing embodiments or make equivalent substitutions to a part of the technical features. Any modifications, equivalent substitutions, improvements and the like made within the spirit and principle of the present invention shall fall within the protection scope of the present invention.

The invention claimed is:

1. A three-layer, three-zone memory foam mattress, comprising:

a mattress main body having a predetermined length dimension and a predetermined width dimension, wherein said mattress main body comprises a one-piece upper layer mattress body having a first predetermined length dimension which is the same as said predetermined length dimension of said mattress main body, and a first predetermined width dimension which is the same as said predetermined width dimension of said mattress main body, an intermediate layer mattress body having a second predetermined length dimension which is the same as said predetermined length dimension of said mattress main body, a second predetermined width dimension which is the same as said predetermined width dimension of said mattress main body, and comprising a plurality of sections which are directly engaged with each other, and a one-piece lower base layer mattress body having a third predetermined length dimension which is the same as said predetermined length dimension of said mattress main body, and a third predetermined width dimension which is the same as said predetermined width dimension of said mattress main body, wherein said upper layer mattress body, said intermediate layer mattress body, and said lower base layer mattress body are sequentially arranged from top to bottom, and wherein at least one of said upper layer mattress body, said intermediate layer mattress body, and said lower base layer mattress body is fabricated from a predetermined material which is different from the material from which the other two of said upper layer mattress body, said intermediate layer mattress body, and said lower base layer mattress body are fabricated so as to provide a mattress user with different comfort and support characteristics; and a mattress cover is disposed atop said mattress main body.

2. The three-layer three-zone memory foam mattress of claim 1, wherein said upper layer mattress body is fabricated from colored gel memory foam.

3. The three-layer three-zone memory foam mattress of claim 1, wherein said lower base layer mattress body is fabricated from physical solid-state reinforced foam.

4. The three-layer three-zone memory foam mattress of claim 3, wherein the ratio of the hardness characteristics of said upper layer mattress body, said intermediate layer mattress body, and said lower base layer mattress body is 2:5:3.

5. The three-layer three-zone memory foam mattress of claim 1, wherein said plurality of sections of said intermediate layer mattress body comprise three sections which are directly engaged with each other and comprise a head mattress body section, a waist and hip mattress body section, and a foot mattress body section.

6. The three-layer three-zone memory foam mattress of claim 5, wherein the ratio of the length dimension of said head mattress body section to the length dimension of said waist and hip mattress body section and to the length dimension of said foot mattress body section is 1:1:1.

7. The three-layer three-zone memory foam mattress of claim 5, wherein said waist and hip mattress body section is fabricated from reinforced resilient foam.

* * * * *